US010479453B2

(12) United States Patent
Klatte

(10) Patent No.: US 10,479,453 B2
(45) Date of Patent: Nov. 19, 2019

(54) RESCUE DEVICE FOR CONTAINERS OF DAMAGED CONTAINER SHIPS

(71) Applicant: Overdick GmbH & Co. KG, Hamburg (DE)

(72) Inventor: Reiner Klatte, Hamburg (DE)

(73) Assignee: Tractebel Overdick GmbH, Hamburg (DE)

( * ) Notice: Subject to any disclaimer, the term of this patent is extended or adjusted under 35 U.S.C. 154(b) by 0 days.

(21) Appl. No.: 15/551,917

(22) PCT Filed: Feb. 15, 2016

(86) PCT No.: PCT/EP2016/053125

§ 371 (c)(1),
(2) Date: Aug. 18, 2017

(87) PCT Pub. No.: WO2016/131752

PCT Pub. Date: Aug. 25, 2016

(65) Prior Publication Data

US 2018/0029674 A1 Feb. 1, 2018

(30) Foreign Application Priority Data

Feb. 19, 2015 (DE) ..... 10 2015 102 398

(51) Int. Cl.
*B66C 1/42* (2006.01)
*B63B 27/10* (2006.01)
(Continued)

(52) U.S. Cl.
CPC ..... *B63B 27/10* (2013.01); *B66C 5/10* (2013.01); *B66C 7/08* (2013.01); *B66C 7/14* (2013.01);
(Continued)

(58) Field of Classification Search
CPC ..... B63B 27/10; B66C 23/206; B66C 23/52; B66C 7/08; B66C 7/14; B66C 5/10
See application file for complete search history.

(56) References Cited

U.S. PATENT DOCUMENTS 2,287,886 A * 6/1942 Kellett ..... B63B 25/004 114/72
2,805,781 A * 9/1957 Senn ..... B66C 13/06 212/274
(Continued)

FOREIGN PATENT DOCUMENTS

CA 2945949 A1 * 10/2015 ..... B63B 35/14
DE 23 08 558 8/1973
(Continued)

*Primary Examiner* — Gregory W Adams
(74) *Attorney, Agent, or Firm* — Bay State IP, LLC

(57) ABSTRACT

The invention relates to a rescue device for a container (7) having container corners (9) loaded onto a damaged ship (110), comprising a crane (50) arranged on a carrier (20, 21, 22), wherein the crane (50) has a front support arm (51), over which a load cable is guided, whose section leading away from the support arm (51) is connected to a container (7) to be unloaded, and the length of which can be changed. The invention is characterized in that the carrier (20, 21, 22) has at least one locking mechanism (204, 205) located opposite the crane (50), by means of which the carrier (20, 21, 22) is temporarily fastened in a releasable manner at the container corners (9) of at least one of the containers (7) fastened on the deck (1) of the damaged ship (110).

15 Claims, 12 Drawing Sheets

Figure 1:
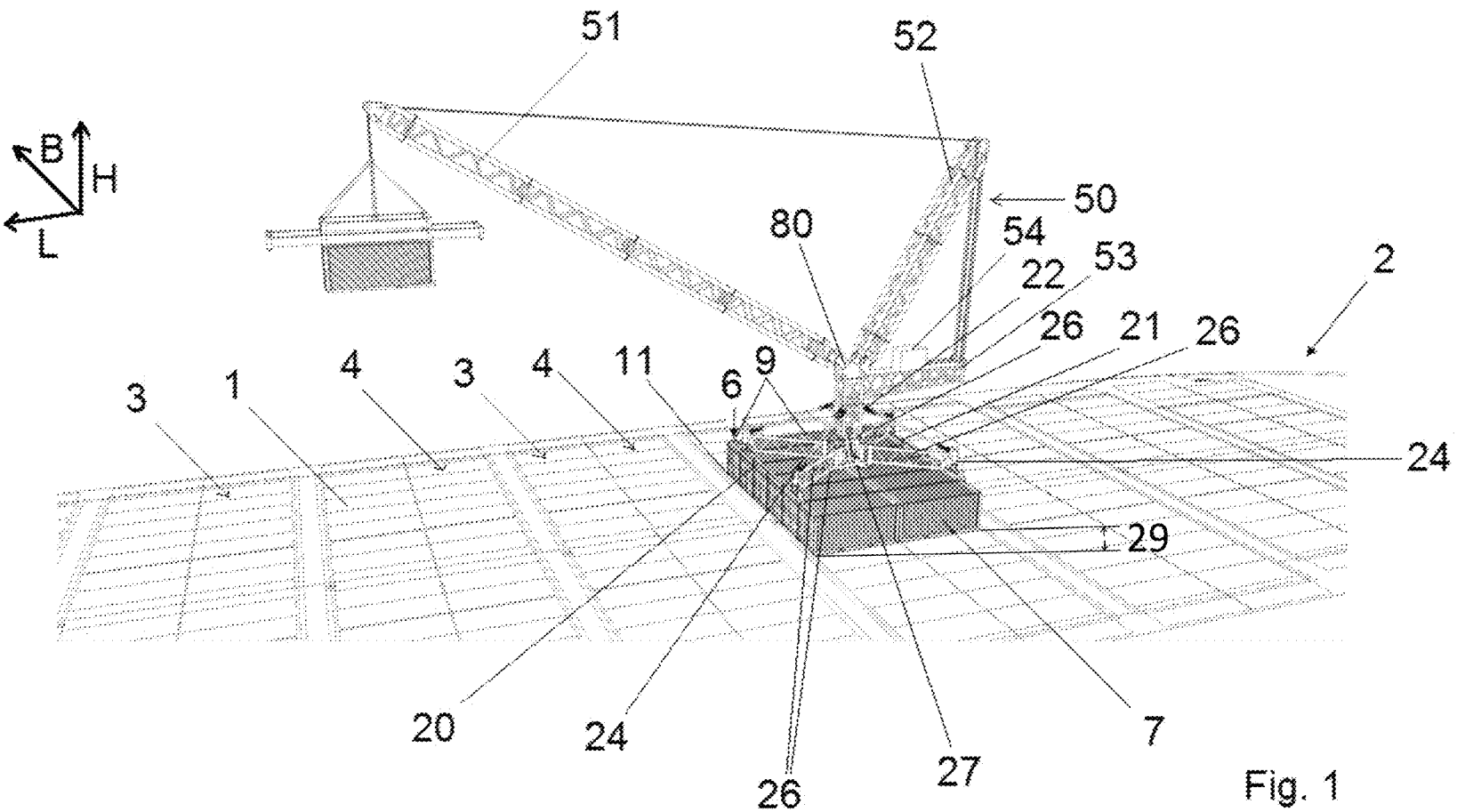

(51) Int. Cl.

| | |
|---|---|
| ***B66C 23/26*** | (2006.01) |
| ***B66C 23/20*** | (2006.01) |
| ***B66C 5/10*** | (2006.01) |
| ***B66C 7/08*** | (2006.01) |
| ***B66C 7/14*** | (2006.01) |
| ***B66C 23/52*** | (2006.01) |

(52) U.S. Cl.
CPC ..... *B66C 23/206* (2013.01); *B66C 23/26* (2013.01); *B66C 23/52* (2013.01)

(56) References Cited

U.S. PATENT DOCUMENTS 3,545,627 A * 12/1970 Letourneau ..... B66C 23/62 212/303
6,572,319 B1 6/2003 Simmons, III
7,686,561 B2 * 3/2010 Smith ..... B66C 3/16 212/301
8,899,902 B2 * 12/2014 Herold ..... B66C 19/002 198/347.1
2011/0163057 A1 * 7/2011 Bjorshol ..... B66C 13/06 212/272
2011/0243698 A1 * 10/2011 Herold ..... B66C 19/002 414/562
2012/0251286 A1 * 10/2012 Van Der Velden ..... B63B 27/10 414/732
2014/0190919 A1 * 7/2014 Rosberg ..... B66C 19/02 212/179

FOREIGN PATENT DOCUMENTS

EP 0 834 459 4/1998
EP 2 196 427 6/2010
WO WO-9729945 A1 * 8/1997 ..... B63B 27/12
WO 2010 037386 4/2010
WO WO-2010037386 A1 * 4/2010 ..... B66C 19/002
WO WO-2010071423 A1 * 6/2010 ..... B66C 19/002
WO 2011 043516 4/2011
WO WO-2013150172 A1 * 10/2013 ..... B66C 19/02

* cited by examiner

RESCUE DEVICE FOR CONTAINERS OF DAMAGED CONTAINER SHIPS

CROSS REFERENCE TO RELATED APPLICATION

This application is for entry into the U.S. National Phase under § 371 for International Application No. PCT/EP2016/000036 having an international filing date of Dec. 15, 2015, and from which priority is claimed under all applicable sections of Title 35 of the United States Code including, but not limited to, Sections 120, 363, and 365(c), and which in turn claims priority under 35 USC 119 to Slovenia Patent Application No. P-201400446filed on Dec. 15, 2014.

The invention relates to a rescue device for standard containers with container corners loaded on a ship, comprising a crane arranged on a support structure. The invention also relates to a flange connection for two opposing annular discs, which are in each case connected in fixed positions to a tube piece, project outwards over tube walls and are in flat contact with one another, and also to process for rescue of standard containers which are loaded on a ship.

US 2012/0 251 286 A1 discloses a lifting device for containers which is symmetrically constructed, so that a lifting means and the foot of the lifting device are structurally identical alternate in their function.

U.S. Pat. No. 6,572,319 B1 discloses a lifting device for containers through a loading hatch in the hull of a ship. However, the lifting device is not suitable for the rescue of damaged containers.

DE 23 08 558 C3 describes a conventional quayside crane, and WO 2011/043 516 A1 discloses a crane on board a separate crane ship.

If cargo ships loaded with standard containers are damaged, i.e. for example run aground, the problem frequently occurs that the cargo ships can no longer be pulled free. They could sink or break up while being pulled free.

In addition to the ship, the ship's load sometimes also has a considerable value. Therefore, naturally, in spite of the shipwreck attempts will still be made to rescue the load.

In order to rescue shipping containers, according to the prior art floating cranes are known which are moved towards the damaged ship and with the aid of which the standard containers are reloaded onto another ship. Disadvantages of the floating cranes are, on the one hand, the considerable costs for hire of the floating crane and, on the other hand, the capacity of floating cranes is limited, and not all floating cranes have a load capacity of 30 tonnes and more, which is necessary, however, in order to be able to actually unload fully laden containers.

Therefore the object of the invention is to provide a rescue device as well as a process for rescuing containers which overcomes or at least reduces the above-mentioned problems.

This object is achieved in a first aspect by a rescue device referred to in the introduction and having with the features of claim 1.

The invention makes use of the idea of providing a rescue device for standard containers with container corners loaded on a ship, with a crane arranged on a support structure. The carrier has at least one, preferably two, three, four or any higher number, of locking mechanisms which are opposite the crane and by which the support is temporarily fastened, preferably temporarily releasably, to container corners of at least of one container fastened to a deck of the damaged ship. The carrier can be mounted on corners of an individual container or on corners of different containers. Therefore the rescue device is mobile and not permanently arranged on the ship.

The support advantageously comprises a support structure and two or any higher number of crane rails.

The rescue device advantageously has two or any higher number of cranes, preferably structural cranes.

Each of the cranes advantageously has a front support arm and advantageously a rear load. On the support arm and optionally on the load arm a load cable is provided which is advantageously guided over rollers. The portion of the support arm leading away from the load cable is connected to a container to be unloaded. The length of the portion of the load cable which leads away from the support arm to the container to be unloaded can be changed. For this purpose winches can be provided which wind up and unwind a rear portion of the load cable.

The crane is preferably arranged on the support structure, wherein the support structure is arranged on the crane rail with in each case two ends which each have a locking mechanism opposite the crane by which the crane rail is temporarily mounted on container corners. In this case a crane rail should be understood very generally to be a bearing device for the support structure. They can have an elongated rail shape, but other starting situations are also conceivable, such as bearing means on individual crane corners, on which feet of the support structure rest.

The invention also makes use of the idea that the containers stacked in rows in bays on the deck of the container ship can be firmly connected to the deck for mounting of the rescue device. Therefore according to the invention the rescue device is temporarily fastened to the containers of the damaged ship.

The containers are preferably standard containers. According to ISO 668 standard containers have standard lengths of 20 or 40 feet with a height of 8.6 feet and a width of 8 feet. Large numbers of standard containers are used for transporting goods. They have eight standardised container corners ("corner castings"). The containers are stacked on the container corners. The container corners of adjacent containers of a container stack can be locked to one another. Standardised components are known for this. The container corners have recesses into which locking pins ("twist locks") mounted on deck can be introduced and engage by twisting inside the recess. As a result on the one hand the containers can be temporarily firmly connected to the deck, and on the other hand the containers stacked one above the other along a container stack can likewise be firmly connected to one another. Thus the container stacks are individually firmly connected to the deck of the ship.

The invention makes use of the idea that the rescue device can be temporarily fastened, i.e. locked, to the container stacks or optionally to the locking pins of the deck itself, and as a result provides a crane which is stationary relative to the damaged ship and is used for rescuing the containers stacked on the container ship stacked container used is.

It has been shown that a rescue device mounted on an individual container has too small a base surface in order then to lift loads up to 40 tonnes by means of a jib of the crane. Therefore the crane rails are laid over a plurality of containers. For this purpose the crane rails are advantageously provided in individual crane rail pieces, wherein an individual crane rail piece corresponds to the width and/or length of a standard container. The crane rail pieces preferably have locking pins which project from the crane rail pieces, wherein the distance between the locking pins corresponds exactly to the distance between container corners of a container.

The locking pins can be configured as conventional "twist locks".

The crane rail pieces are mounted on containers arranged adjacent to one another and are connected by means of connecting pieces in each case to one of the crane rails.

The container stacks have a non-standardised spacing parallel to the deck. They are stacked in direct contact with one another or at a short distance from one another. Therefore crane rail pieces are preferably connected by means of connecting pieces to a spacing piece corresponding to the spacing of the container stacks. As a result it is advantageously possible to construct flat continuous crane rails extending over a plurality of containers.

The crane rails are advantageously laid parallel to one another on an upwardly free container layer of a container load, wherein the free container layer must have the same height, so that the crane rails can be laid over the entire container layer.

The crane rails can be laid in the longitudinal direction of the ship or along a width of the ship.

In a preferred embodiment of the invention a traction device is arranged in each case on the ends of the crane rails. The traction device advantageously comprises strand jacks. Strand jacks make it possible during an adjusting step to shorten and lengthen a piece of traction cable projecting from the strand jack. In this case the traction cable is alternately gripped by hydraulically activated clamping rings. The four traction devices are controlled in co-ordination with one another and make it possible, by so connections of a traction device to a respective crane foot, to move the support structure with the crane to and fro in the longitudinal direction the crane rails.

The support structure preferably has a central crane stand with at least four diagonal supports which are mounted thereon and are in each case mounted on a crane foot arranged on one of the crane rails.

Connections, which are continuously adjustable by rotation and can be fixed in any rotated position, of a crane foot and a diagonal support on an outer end and between the crane stand and crane support at an inner end make it possible to compensate for slight differences in spacing and length.

The connection is preferably achieved by a flange connection described below, which enables a firm connection of two flanges at a continuously adjustable angle.

The crane stand preferably has a removable bolt, on which a fork piece of a crane is fitted, wherein the bolt is arranged in the longitudinal direction of the ship, preferably perpendicular to the longitudinal direction of the crane rail arranged parallel to one another. The orientation of the bolt perpendicular to the longitudinal direction of the crane rails and thus preferably exactly in the longitudinal direction of the ship takes account of the fact that the damaged ships have a substantial heel 28 and as a rule only very little trim 29.

A fork piece which is arranged rotatably around the bolt is fitted onto the bolt. The fork piece has, on a portion located opposite the crane stand, a mounting platform for the crane. Initially the mounting platform of the crane is not oriented exactly horizontally, but in order to compensate for the heel 28 and the trim 29 it does not have to be adjustable by the same order of magnitude.

Connecting pieces are advantageously provided which are arranged in each case between a crane foot and a holder on the crane stand on a portion of the fork piece facing the crane, and which are dimensioned in terms of their length in such a way that they exactly compensate for the heel of the crane rails and thus the heel of the damaged ship.

In order to compensate for the trim 29 of the crane rails and thus of the damaged ship, compensating pieces are provided at connection points between the crane feet and the diagonal supports. The compensating pieces have a thickness of a few centimeters.

For construction of the rescue device the flange connection according to the invention is also provided with two opposing flanges, which are each connected in fixed positions to a tube piece and which project externally over tube walls and are in flat contact with one another and which in each case have opposing elongate holes which are arcuate in the peripheral direction, wherein in each case a screw which is preferably circular in cross-section is guided through pairs of elongate holes. By the provision of the flanges with elongate holes it is possible to rotate the flanges with respect to one another about their longitudinal axes and nevertheless to insert always the same number of screws, preferably 12 screws, through pairs of elongate holes and to tighten them and thus to form a firm flange connection in each rotated position.

In a second aspect the object is achieved by a process for rescuing containers having the features of claim 14, wherein a rescue device is mounted on at least one container stack fastened on a deck of the damaged container ship, wherein a support is temporarily firmly mounted on the at least one container stack at container corners and a crane is mounted on the support.

The rescue device is preferably mounted on the at least one container stack, wherein two first crane rails are mounted parallel to one another on the at least one container stack and a support structure is mounted on the two crane rails and a crane is mounted on the support structure.

With regard to the method the invention likewise makes use of the idea that a crane can be mounted on the containers or container stacks firmly mounted on the deck. The process is preferably carried out with one or more of the rescue devices described above.

The rescue device is preferably used for mounting of a further rescue device on at least one further container stack. The rescue device can only rescue adjacent containers which are only some of the containers of the entire ship's cargo. Further containers can be rescued by the construction of a further rescue device, which is preferably erected on the next but one container stack in the longitudinal direction. The further containers cannot initially be reached by the rescue device.

The further rescue device is preferably for removing the rescue device and constructing it again at a different location.

Two crane feet which are movable to and fro along the crane rails are preferably placed on each of the crane rails, and at each end of the crane rails a respective traction device is mounted which is connected to the next crane foot by traction means, preferably strand jacks, with traction cables.

A trim of the crane rails is preferably compensated for by the insertion of spacing pieces into a connection point between crane feet and diagonal supports. The diagonal supports are connected to a central crane stand having a bolt which is oriented parallel to the longitudinal direction of the ship and onto which a fork piece is fitted, and the fork piece is rotated about the bolt until a mounting plate of the fork piece has a mounting position without heel. The mounting position is fixed by means of adapter pieces which in each case are arranged between the crane foot and a holder on the crane stand. The length of the adapter pieces is dimensioned so that they hold the fork piece in the mounting position, wherein in the mounting position a mounting plate on which the crane can then be mounted is arranged exact horizontally.

The invention is described with reference to an exemplary embodiment in 29 figures, in which:

FIG. 1 shows a perspective view of a rescue device according to the invention.

Figure 2A:
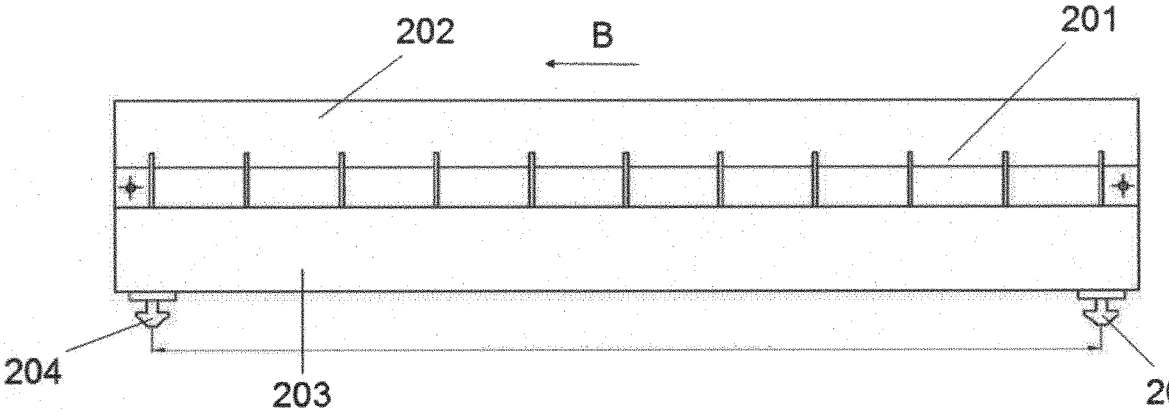
Figure 2B:
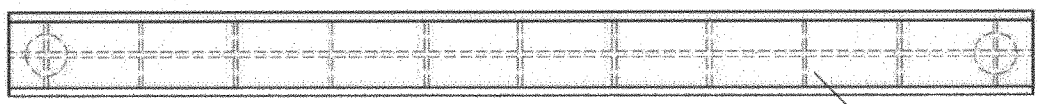
Figure 2C:
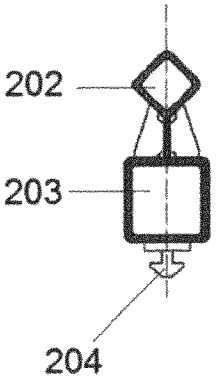
Figure 3B:
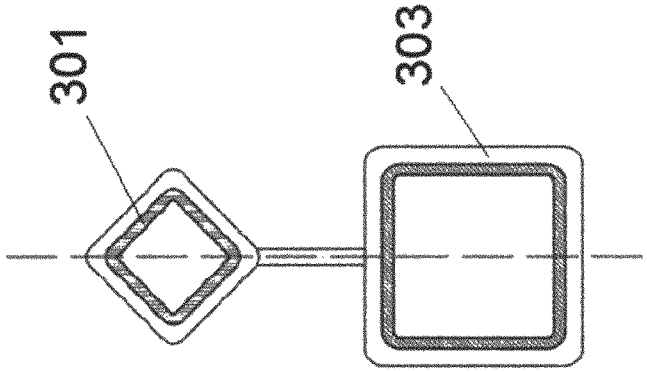
Figure 3A:
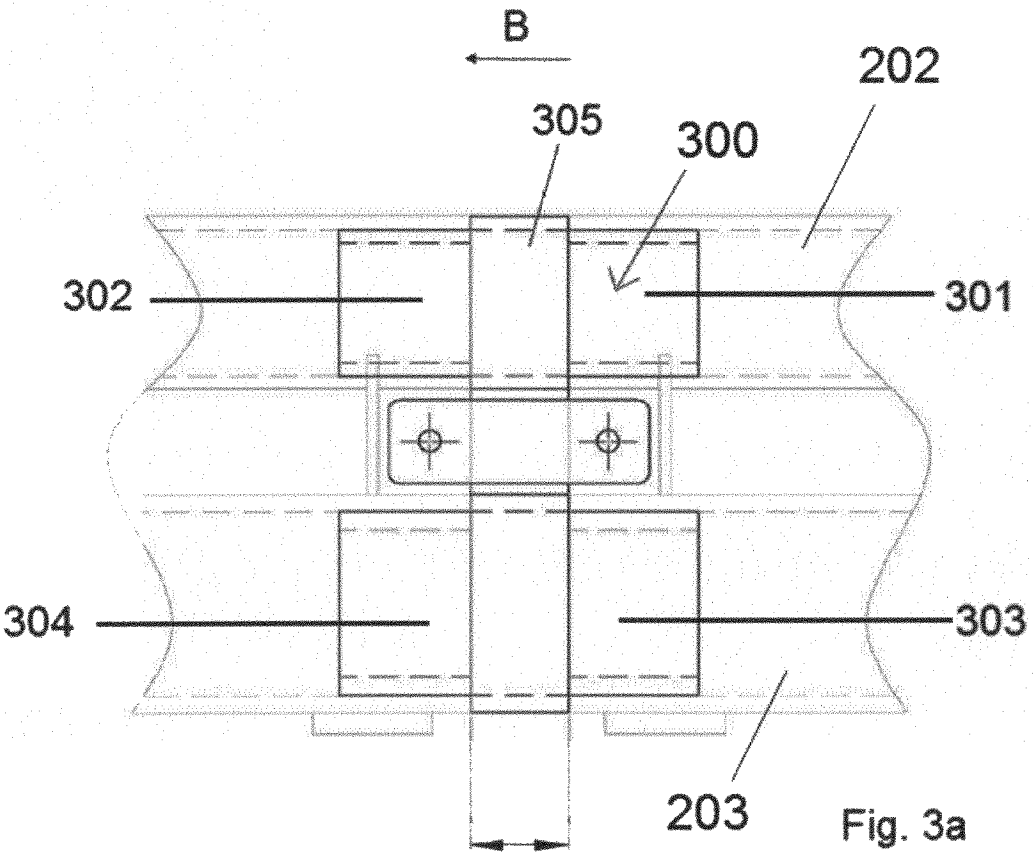
Figure 4:
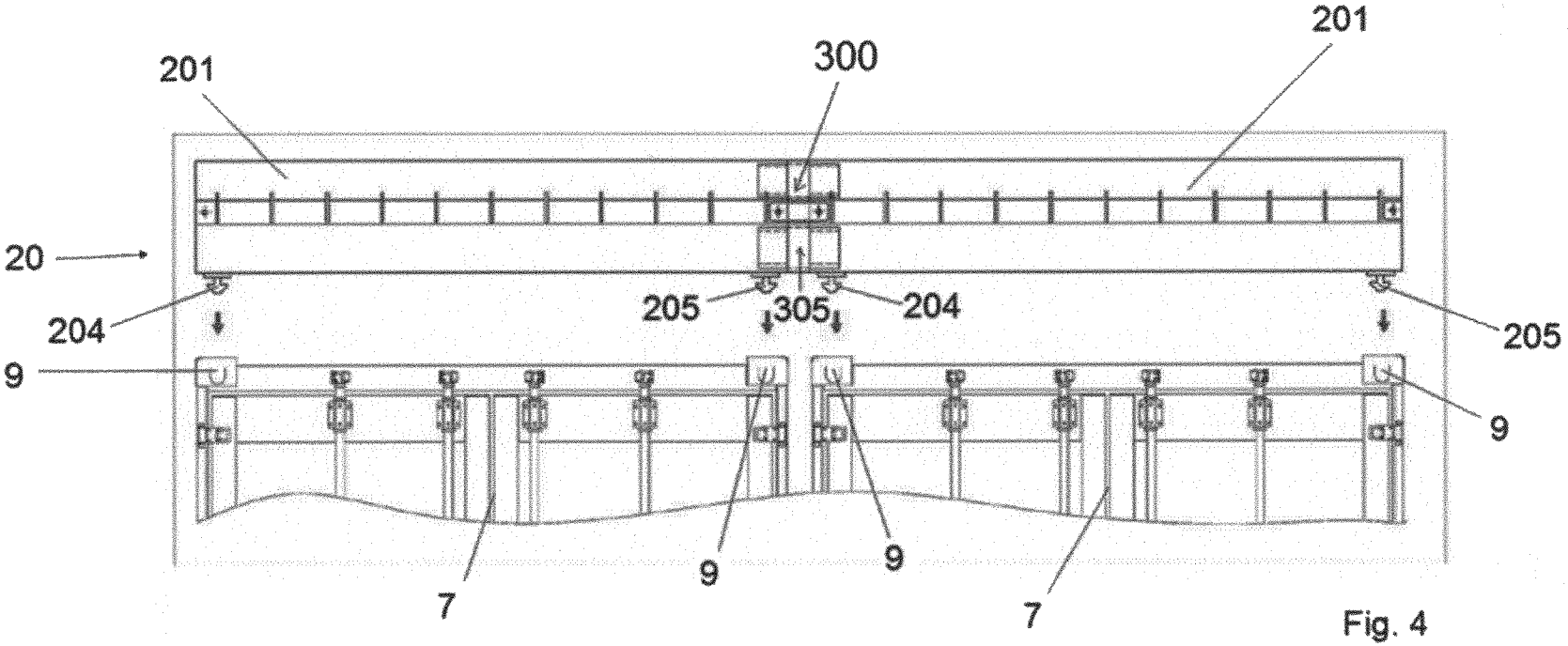
Figure 5:
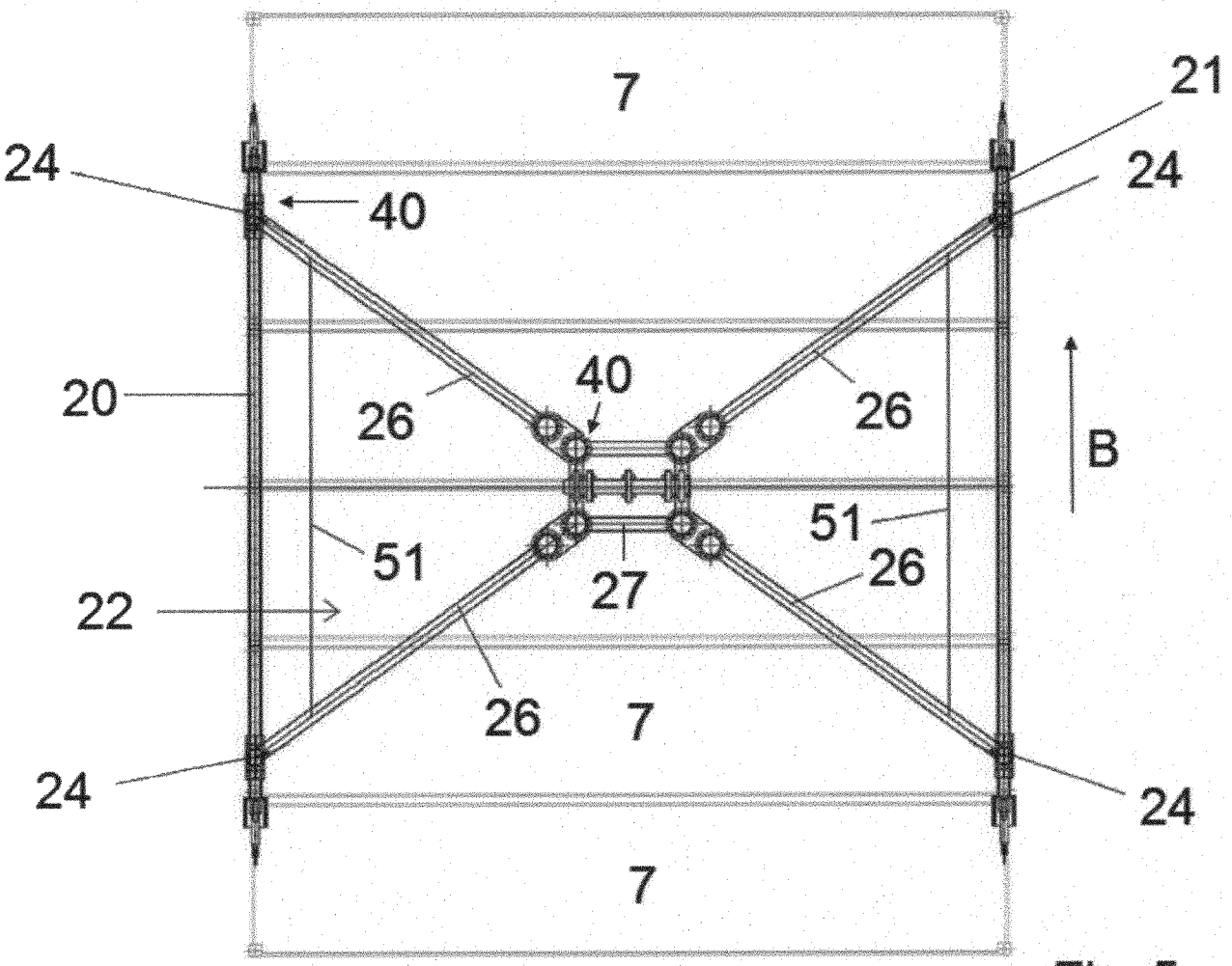
Figure 6:
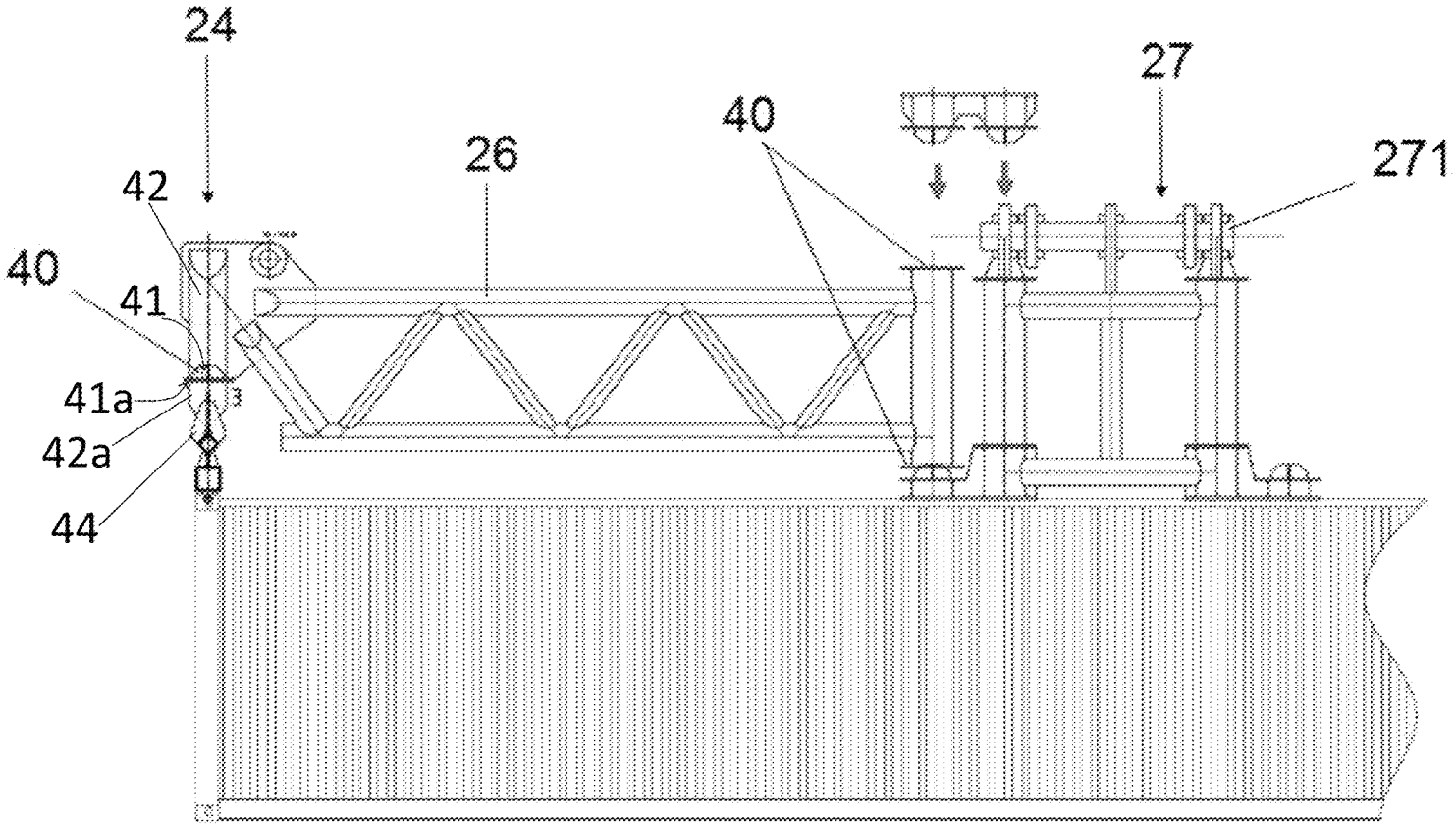
Figures 7A, 7B, 7C, 7D, 7E:
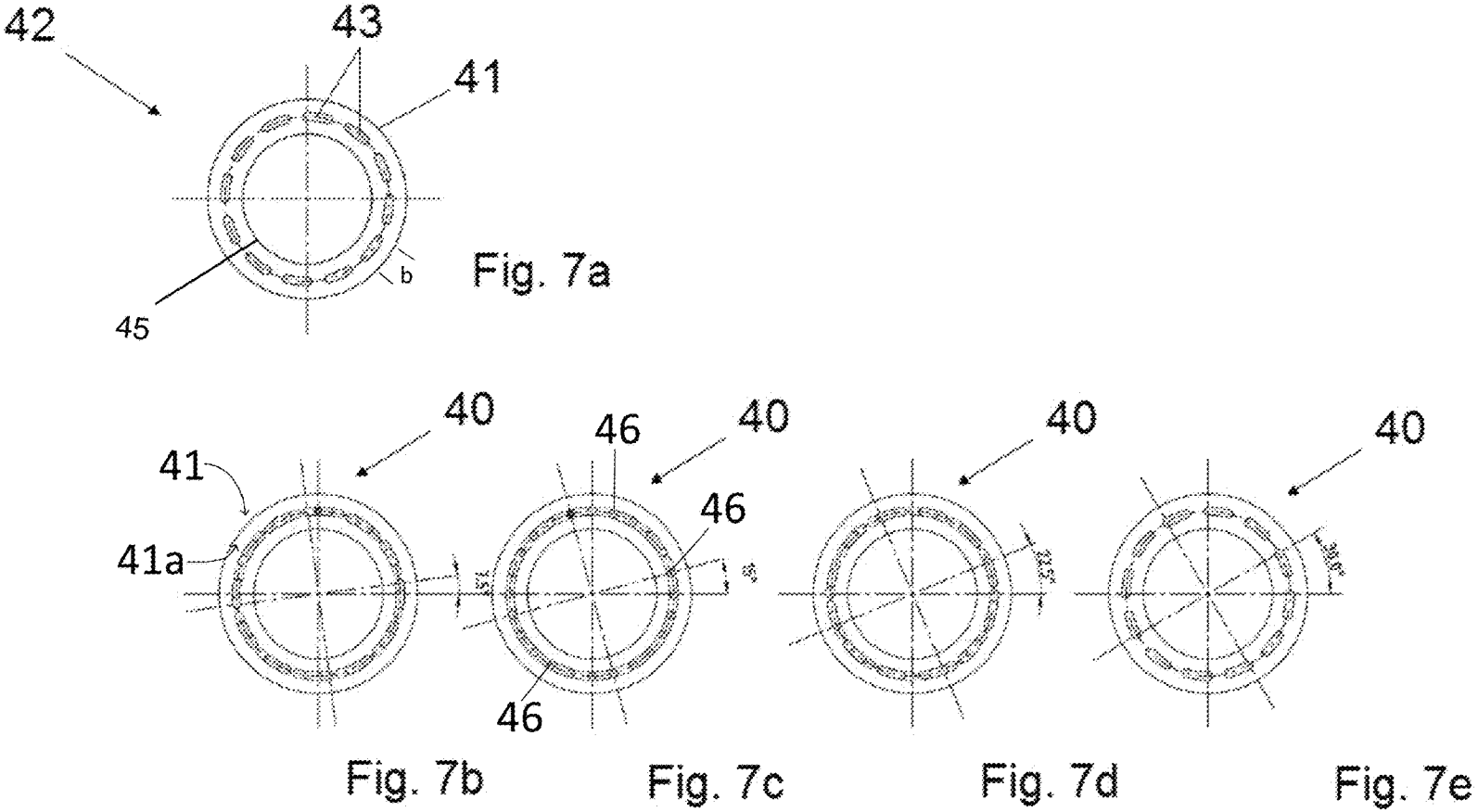
Figure 8C:
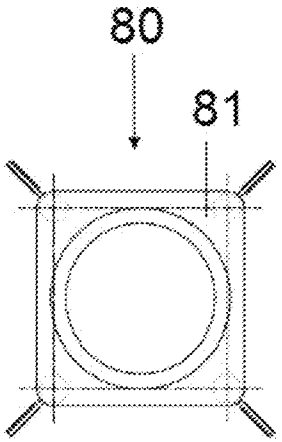
Figure 8B:
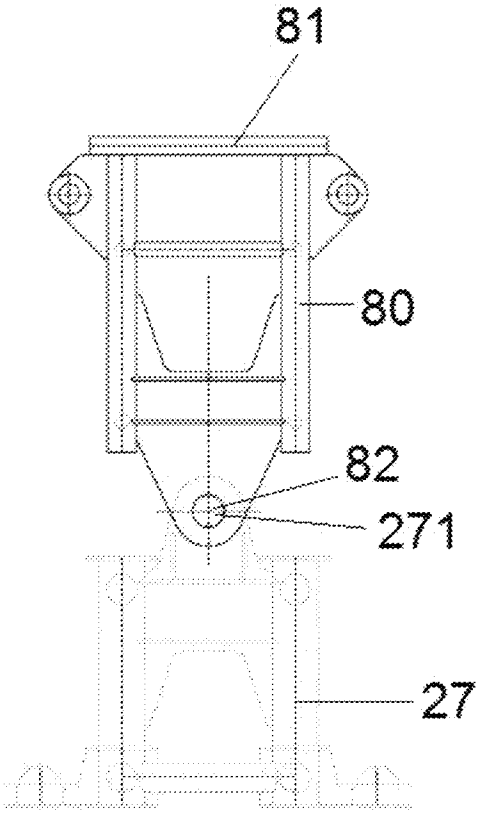
Figure 8A:
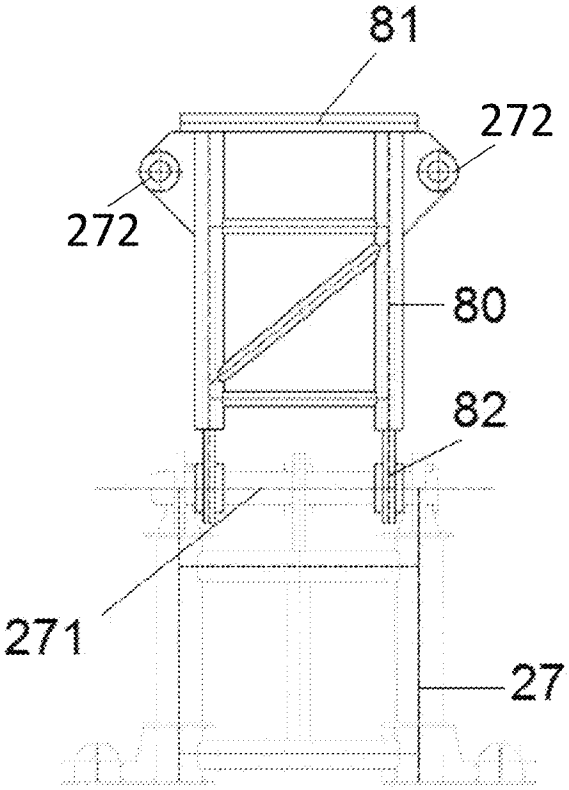
Figure 9:
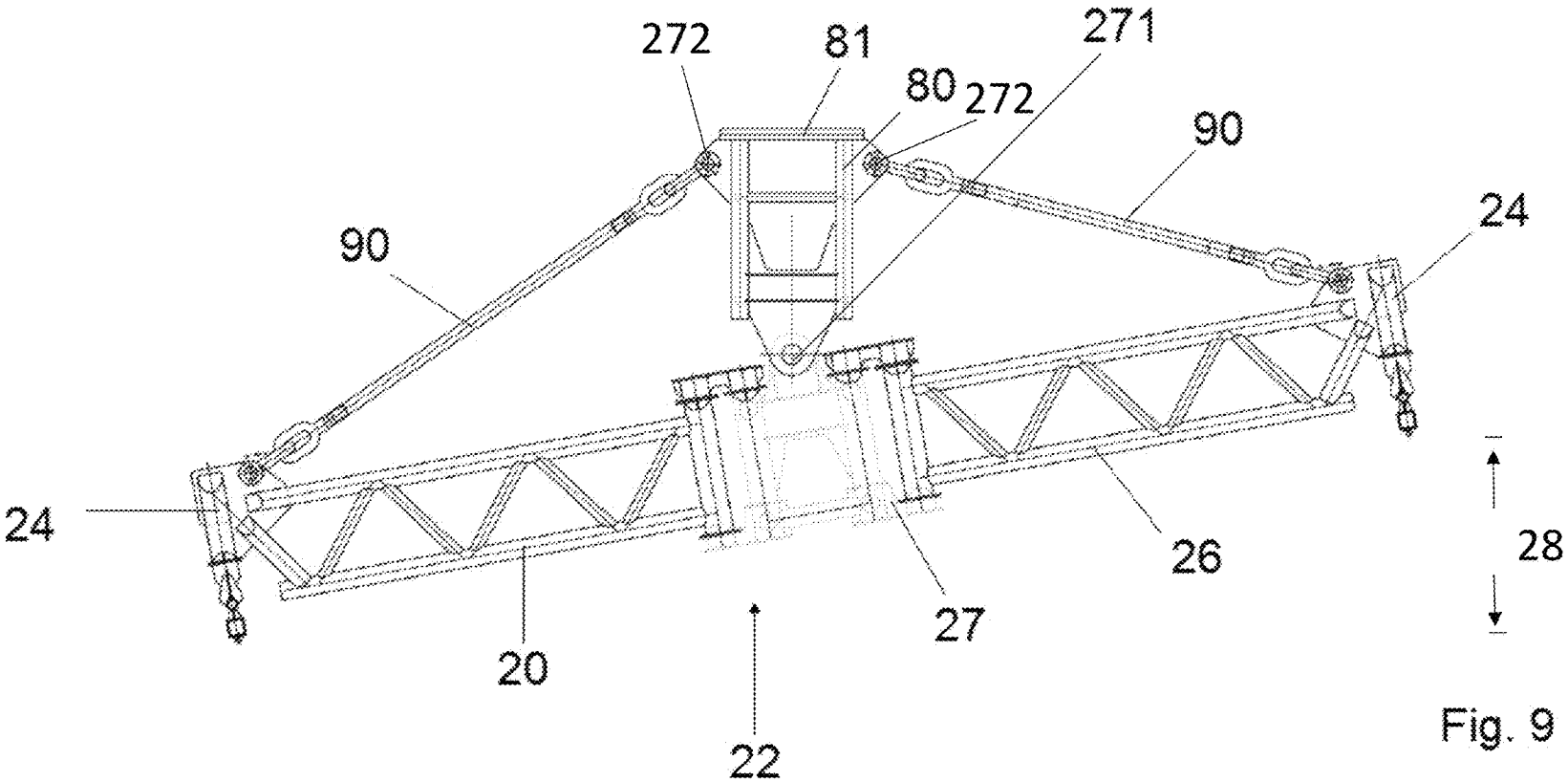
Figure 10A:
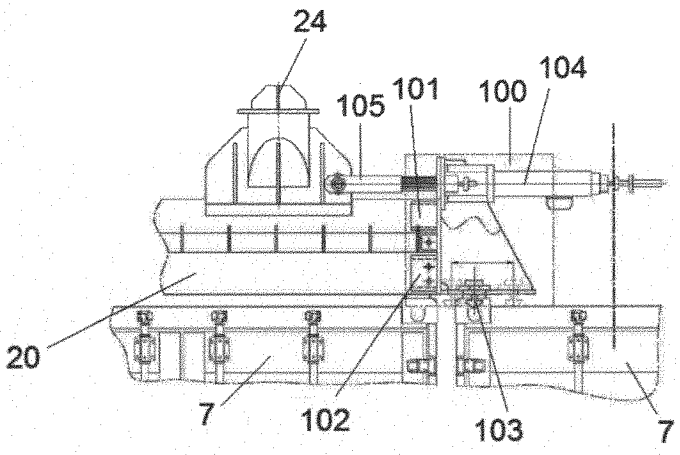
Figure 10B:
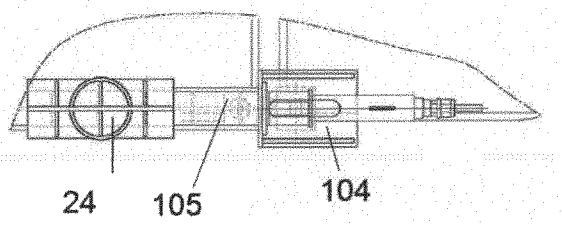
Figure 10C:
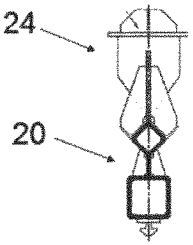

FIG. 2*a* shows a crane rail piece according to the invention in a side view, FIG. 2*b* shows the crane rail piece of FIG. 2*a* in a plan view, FIG. 2*c* shows crane rail pieces in a sectional view, FIG. 3*a* shows a connecting piece of two crane rail pieces in a side view, FIG. 3*b* shows a sectional view of the connecting piece of FIG. 3*a*, FIG. 4 shows a functional view of the mounting of a crane rail on four container corners of two adjacent standard containers, FIG. 5 shows a schematic plan view of a support structure according to the invention with two crane rails, FIG. 6 shows a lateral view of a diagonal trainer with a crane stand in FIG. 5, FIGS. 7*a*-7*e* show a flange connection according to the invention in FIG. 6, FIG. 8*a* shows a fork piece in a front view, FIG. 8*b* shows the fork piece of FIG. 8*a* in a side view, FIG. 8*c* shows the fork piece of FIG. 8*a* in a plan view, FIG. 9 shows a support structure on two crane rails with a heel, FIG. 10*a* shows a side view of a traction device according to the invention, FIG. 10*a* shows a plan view of FIG. 10*a*, FIG. 10*c* shows a sectional view of FIG. 10*a*, FIGS. 11*a*-11*h* shows process steps of a rescue process for standard containers of a damaged ship.

FIG. 1 shows schematically a deck 1 with a plurality of container bays 2 arranged transversely with respect to the longitudinal direction of the ship. Each of the container bays 2 has two rows of container slots 3, 4 for container stacks 6. In FIG. 1 six container stacks 6 each comprising one container 7 are shown only in one of the container bays 2. Naturally the container stacks 6 can also have two, three or a higher number of containers 7. Likewise different container stacks 6 can be built up to different heights above the deck 1. A rescue device 8 according to the invention is mounted on the containers 7. For each container 7 the container slots 3, 4 in each case have four fastening devices for container corners 9 of a container 7. Containers 7 are usually in the form of standard containers with a width of 8 feet and a length of 20 feet or 40 feet.

The container arrangement illustrated in FIG. 1 is arbitrary. The containers 7 can be stacked in almost any number and arrangement on the deck 1.

FIG. 1 shows a plurality of 20 foot standard containers of which the lowermost position arranged directly on the deck 1 is locked by means of locking devices 11 on each of their container corners 9 on the container slots 3, 4 of the container bays 2. In addition, directly adjacent containers 7 of a container stack 6 are locked firmly to one another along a height H perpendicular to the deck 1 by means of locking devices 11. In this way it is ensured in principle that the containers 7 of a container stack 6 are firmly connected to the deck 1 and also do not slip or even fall overboard while at sea.

The invention makes use of the idea that, instead of bringing a rescue device 8 in the form of a floating crane alongside a damaged ship and carrying out the rescue with the aid of the floating crane or using a crane located on the land to rescue the containers 7 from a ship which has run aground right on the shore, the rescue device 8 can be mounted on the containers 7 which are on the deck 1 and are firmly locked to the deck 1.

For this purpose two crane rails 20, 21 are arranged parallel to one another perpendicular to the longitudinal direction L along a width B of the ship. Each of the crane rails 21, 21 runs on a free surface remote from the deck 1 which is formed by the top walls of a plurality of containers 7. The top walls have an identical height H above the deck 1. The crane rails 20, 21 are guided along container edges of front faces of the containers 7 arranged adjacent to one another and remote from the deck 1.

In FIG. 1 each of the two crane rails 20, 21 is guided, in this example, along four container edges. On the two crane rails 20, 21 is mounted a support structure 22 which is spaced above the top walls of the containers 7 and introduces the entire weight of the rescue device 8 into the two crane rails 20, 21 exclusively via four structurally identical crane feet 24. The support structure 22 has four structurally identical diagonal supports 26 which are each connected in an articulated manner at their outer ends to a respective crane foot 24 seated on a respective one of the crane rail 20, 21. The inner ends of the diagonal supports 26 running towards one another are connected in an articulated manner to a crane stand 27.

The articulated connection is produced here by means of a flange connection 40 according to the invention, as illustrated in FIGS. 7*a*-7*e*.

A fork piece 30 according to FIGS. 8*a*, 8*b*, 8*c*, which on the end remote from the deck 1 has a mounting surface 31 on which a crane 50 is mounted, is arranged on the crane stand 27. The crane 50 has a front support arm 51 and a rear jib 52 as well as a base frame 53, on which drives 54 for winches are provided. With the winches, on the one hand a load cable is driven, and on the other hand a control cable for changing the setting angle of the front support arm 51 is operated. The crane 50 is mounted rotatably on the fork piece 30.

FIGS. 2*a*, 2*b*, 2*c* show the structure of a crane rail piece 201. The two crane rails 20, 21 in FIG. 1 each comprise four crane rail pieces 201. A length of a crane rail piece corresponds to the width of a standard container 7 of eight feet. Each crane rail 20, 21 can have a lower or higher number of crane rail pieces 201.

FIG. 2 shows a crane rail piece 201 in a side view. The crane rail piece 201 has two profiles 202, 203 of square cross-section which are arranged parallel to one another, are rotated relative to one another at an angle of 45° about their respective longitudinal axis and are also connected to one another at fixed positions under load. On a side facing the container 7, a container-side profile 203 has on each of its ends a locking pin 204, 405 which is provided for locking to the standardised container corners 9 of the container 7.

FIG. 2*b* shows the crane rail piece 201 in a plan view, wherein the central broken line represents the upper edge of the crane-side profile 202 rotated about 45° and the two outer solid lines represent the outer boundary of the crane-side profile 202. The crane feet 24 rest on the crane-side profile 202.

FIG. 2 shows the crane rail piece 201 in a side view. This shows the locking pin 204 which is provided to be introduced into the upper recess of a respective container corner 9 in order then to be firmly locked in the container corner 9 from the exterior by rotary movement.

FIGS. 3*a* and 3*b* show connecting pieces 300 for adjacent crane rail pieces 201 to form the two crane rails 20, 21 in FIG. 1.

The crane rail pieces 201 of FIGS. 2*a*-2*c* have a length L which corresponds to the width B of a standard container. However, the length L is usually too short in order for the rescue device 8 according to the invention as shown in FIG. 1 to be mounted on the container stack 6 so as to be sufficiently stable under load during the rescue operations.

According to the invention the containers 7 arranged exactly on a deck 1 in an exact rectangular pattern with overlapping containers are used as a stable mounting surface 81. For this purpose, along an upper container layer of a container bay 2 adjacent containers 7 are provided with crane rail pieces 201 according to FIGS. 2*a*-2*c*, and adjacent crane rail pieces 201 are firmly connected to one another with connecting elements 30 according to FIGS. 3*a* and 3*b*. In a side view in FIG. 3*a* the connecting piece 300 has four bushings 301, 302, 303, 304, of which two aligned opposing crane-side bushings 301, 302 have in their outer dimensions a cross-section which corresponds exactly to the free internal cross-section of the two adjacent hollow crane-side square profiles 202 of the crane rail pieces 201 in FIGS. 2*a*-2*c*.

Two container-side bushings 303, 304 have in their outer dimensions a cross-section which corresponds exactly to the free internal cross-section of the two hollow container-side square profiles 203 of the adjacent crane rail pieces 201 in FIGS. 2*a*-2*c*.

Furthermore the bushings 301, 302, 303, 304 are arranged in pairs exactly opposite and parallel to one another, so that according to FIG. 4 they can be inserted into the open ends of the profiles 202, 203 of neighbouring crane rail pieces 201 and together with den crane-side profiles 202, 203 form a straight contact surface or contact edge for the crane feet 24.

FIG. 3*b* shows the connecting piece 300 in a side view. Spacing pieces 305 of the connecting pieces 30 can have a different length in the direction of the crane rails 20, 21. According to the invention a set of connecting pieces 30 with spacing pieces 305 of different lengths are kept in stock in order to be able to provide these pieces appropriately for the corresponding loading situation of the respective container ship 110. In fact the fastening devices are not exactly standardized in the container bays 2 of the deck 1, so that depending upon the ship spacings can occur which differ slightly from one another between containers 7 which are adjacent along the width B. This fact is taken into account by the spacing pieces 305 of the connecting pieces 30 which are adapted according to these distances.

FIG. 4 shows two crane rail pieces 201, which together form a crane rail 20 and are connected to one another by means of the connecting piece 300. The crane rail 20 is fitted with its four locking pins 204, 205 into the four container corners 9 of the two containers 7 which are arranged exactly adjacent to one another and are aligned parallel to one another, and after introduction of the locking pins 204, 205 into the container corners 9 the locking pins 204, 205 are locked by rotary movement. Thus the crane rail 20 is mounted firmly on the crane-side short container edges of adjacent containers 7.

Provision is made for mounting the two crane rail pieces 201 of the two crane rails 20, 21 parallel to one another with a spacing of 40 feet relative to one another on the container edges of a large standard container or two small standard containers. The distance of 40 feet corresponds to the spacing between two outer short container edges in the longitudinal direction L of short 20 foot standard containers arranged adjacent to one another or the spacing between short container edges of a long 40 foot standard container.

In a schematic view FIG. 5 shows the support structure 22 of the rescue device 8 according to the invention which is already mounted on the two crane rails 20, 21. The support structure 22 includes the central crane stand 27 which is connected by means of the four diagonal supports 26 to four crane feet 24 in an articulated manner. The four crane feet 24 sit in pairs on a respective crane rail 20, 21. At their outer end and at their inner end the diagonal supports 26 are connected rotatably and lockably to the crane stand 27 by the crane feet via the flange connection 40.

The support structure 22 is arranged along the width B of the container ship 110, i.e. in FIG. 5 along the width B of the container 7 so as to be movable to and fro on the two crane rails 20, 21. A spacing limiting element 55 in the form of a traction cable or a pipe is provided in each case between diagonal supports 26 of a crane rail 20, 21, so that a pulling movement on one of the crane feet 24 can be transferred by means of the spacing limiting element 55 into the other crane foot 24 of the same crane rail 20, 21.

The support structure 22 is moved by a traction device 100 according to FIG. 10. Precisely one traction device 100 according to FIGS. 10*a*, 10*b*, 10*c* is provided on each of the four ends of the two crane rails 20, 21; in this case the traction device 100 is mounted at one end of a crane rail 20, 21. First of all it has two bushings 101, 102 which, corresponding to the spacing pieces 30, are likewise inserted into the open ends of the two profiles 202, 203 of the crane rails 20, 21. Furthermore, the traction device 100 has a locking pin 103 which is set into a free container corner 9 of an adjacent container 7 and can be locked there. The crane rail 20, 21 is not guided over the container corner 9 of the adjacent container 7.

On the side opposite the locking pin 103 the traction device 100 has a strand jack 104. Strand jacks 104 are known in principle; they make it possible to shorten or to lengthen a traction cable 105 in the adjusting step by means of hydraulically operated clamping rings; the traction cable 105 is connected to an adjacent crane foot 24 according to FIG. 10.

FIG. 10*b* shows the arrangement according to FIG. 10*a* in a plan view. In this case the strand jack 104 is arranged on the right, and the crane foot 24 is arranged on the left, and both are connected to the traction cable 105.

FIG. 10*c* shows a side view, showing that the crane foot 24 rests from above on the upper square profile 202, 203, which is rotated by 45°, and can be moved along the upper profile 202 by means of the end piece. By control of the strand jacks 104 of the four traction devices 100, movement to and fro along the width B of the container ship 110 is possible, i.e. along the crane rails 20, 21.

FIG. 6 shows a diagonal support 26 and the crane stand 27 as well as a crane foot 24 in a schematic, partially exploded view. In the mounted state of the rescue device 8 the crane stand 27 is spaced 50 mm-70 mm above the container. Thus the entire weight of the rescue device 8 rests on the four crane feet 24. The diagonal supports 26 have two of the flange connections 40 on their inner end and a respective one of the flange connections 40 on their outer end.

The flange connection 40 is likewise configured inventively. In this case two lube pieces 42, 42*a* arranged parallel to one another are provided with flanges 41, 41*a* which extend concentrically around the tube piece 42 and are placed flat on one another in order to form the flange connection 40. Each of the flanges 41 has a peripheral elongate holes 43 of which the arc length is configured so that, in each angular position of the two tube pieces 42, 42*a* around their longitudinal axis relative to one another, twelve screws 46 of round cross-section can be passed through pairs of elongate holes 43, screwed tightly and thus form a firmly locked flange connection 40. In this way it is possible to lock the diagonal support 26 firmly in each angular position relative to the crane foot 24 and also relative to the crane stand 27.

FIGS. 7*a*-7*e* show the formation of a flange 41 in FIG. 7*a*. A complementary flange 41*a* is correspondingly constructed, and FIGS. 7*b*, 7*c*, 7*d*, 7*e* show the two flanges 41, 41*a* placed one upon the other with their plurality of peripheral arcuate elongate holes 43, which are configured in their arc length b so that in any angular position the twelve screws 46 of round cross-section can be guided through pairs of elongate holes 43 located on one another.

FIG. 8*a*-8*c* show the fork piece 80*n* which is mounted on the crane stand 27. The crane stand 27 has a bolt 271 which is arranged in the longitudinal direction L of the container ship 110. The bolt 271 is removable and also, for mounting of the crane 50 on the side of the crane stand 27 remote from the deck, is first of all pulled out of eyelets 272, the the fork piece 80 is positioned so that the bolt 271 can be guided both through the eyelets 272 of the crane stand 27 and also through holes 82 in a fork of the fork piece 80. Thus the fork piece 80 is pivotable to and fro about the bolt 271 of the bolt axis extending in the longitudinal direction L of the container ship 110. This takes account of the fact that in a damage ship a heel angle 28 is significantly greater than a trim angle 29 and the heel angle 28 can be compensated for by rotation of the fork piece 80 around the bolt 271.

The positioning of the fork piece 80 relative to the crane stand 27 and the diagonal supports 26, i.e. the support structure 22, is shown in FIG. 9. The two outer crane rails 20, 21 are firmly mounted on the containers (not shown). In this case the container ship 110 is damaged and has a heel a of approximately 20°. The position of the fork piece 80 compensates for the heel by rotation of the fork piece 80 around the bolt 271 likewise by 20°. The position of the fork piece 80 with respect to the crane stand 27 is fixed with the aid of four adapter pieces 90 which are constructed as adjustable tubes which can be adjusted in their length. The adapter pieces 90 are firmly mounted both on crane-side eyelets 272 of the fork piece 80 and also on eyelets 272 of the crane feet 24 and keep the fork piece 80 fixed in a heel angle with respect to the diagonal supports 26.

Figure 11A:
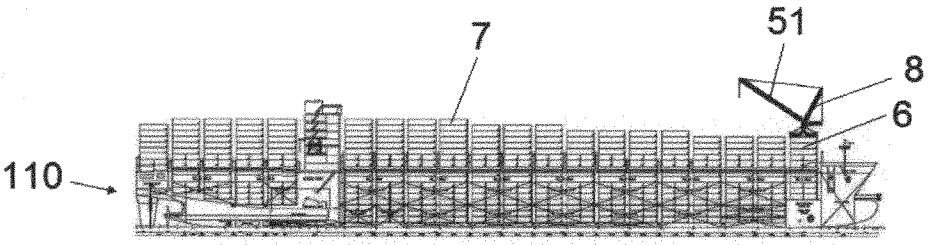

FIGS. 11*a*-11*h* show a rescue process according to the invention for containers 7 of a container ship 110 by means of two rescue devices 8, 111. In FIG. 11*a* a rescue device 8 is already mounted on a bow-side container stack 6, which in this case is a stack of 40 foot standard containers. The mounting of the rescue device 8 can take place with the aid of a floating crane. Since the individual components of the rescue device 8 are dimensioned so that each component weighs at most five buoys, a relatively small floating crane is necessary for construction of the rescue device 8, whilst both the first rescue device 8 and also the further rescue device 111 described later can each have a lifting capacity of 40 tonnes. The 30 tonnes correspond to the maximum payload of a large 40 foot standard container.

Provision is also made to mount the rescue device 8 from a pontoon, and thus a floating crane can be avoided.

Figure 11B:
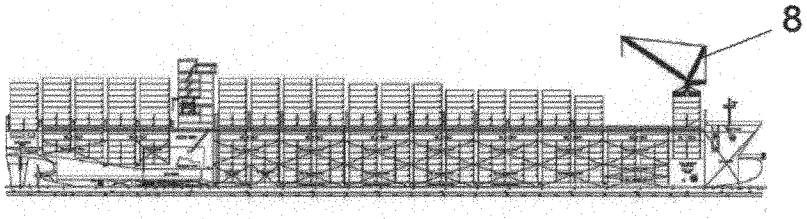
Figure 11C:
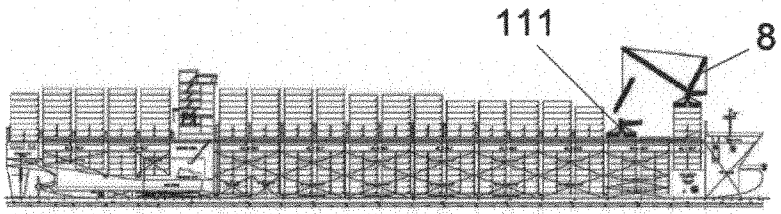
Figure 11D:
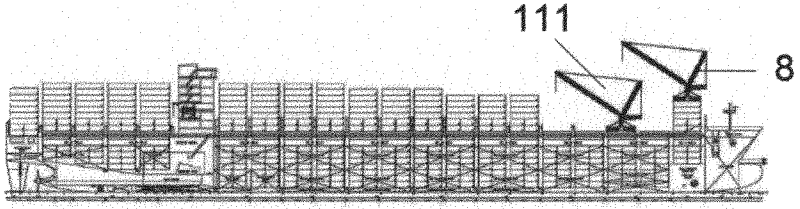

In a second process step according to FIG. 11*b* the containers 7 located in grab range up to one container height are rescued, so that adjacent containers 7 can still be reached by the support arm 51. In FIG. 11*c* the further structurally identical rescue device 111 is erected on the next but one, partially removed container stack 6, and the next two rows of container stacks are rescued with the aid of the further rescue device 111 according to FIG. 11*d*.

Figure 11E:
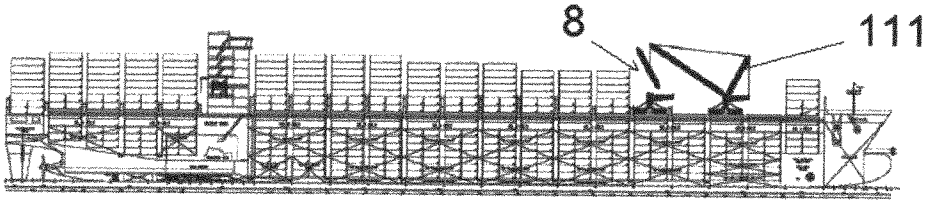
Figure 11F:
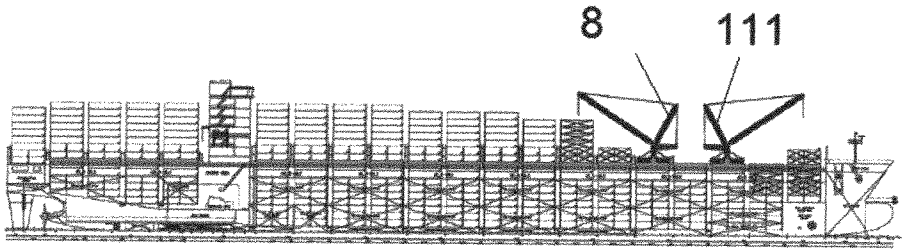
Figure 11G:
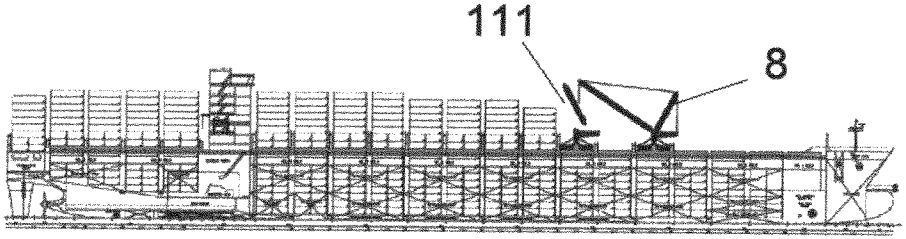
Figure 11H:
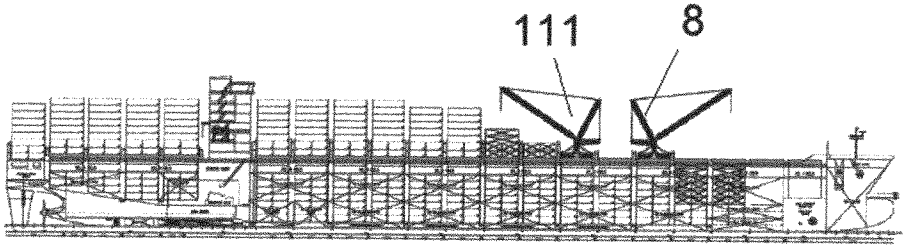

FIG. 11*e* shows that with the aid of the further rescue device 111 the rescue device 8 is removed and is erected again on the next but one container stack 6 directed novel towards the stem. With the aid of the rescue device 8, the next two rows of container stacks on the stem side are then unloaded to the same height, whilst with the containers 7 of the two first container stacks 6 which still remain are rescued by the further rescue device 111. This process is continued until the containers 7 of the container ship 110 are completely rescued. Naturally other sequences or modalities of the container rescue are also conceivable.

LIST OF REFERENCE SIGNS

1 deck
2 container bays
3 container slots
4 container slots
6 container stack
7 container
8 rescue device
9 container corners
11 locking devices
20 crane rail
21 crane rail
22 support structure
24 crane foot
26 diagonal support
27 crane stand
28 heel
29 trim
40 flange connection
41 flange
41*a* flange
42 tube piece
42*a* tube piece
43 elongate holes
46 screws
50 crane
51 support arm
52 jib
53 base frame
54 drives
55 spacing limiting element
80 fork piece
81 mounting surface
82 holes
90 adapter pieces
100 traction device
101 bushing
102 bushing
103 locking pin
104 strand jack
105 traction cable
110 container ship
111 further rescue device
201 crane rail piece

202 profile
203 profile
204 locking pin
205 locking pin
271 bolt
272 eyelets
300 connecting piece
301 bushing
302 bushing
303 bushing
304 bushing
305 spacing piece
B width
H height
L longitudinal direction

The invention claimed is:

1. Rescue device for containers (7) with container corners (9) loaded on a damaged ship (110), comprising:

at least two crane rails (20, 21) arranged parallel to one another;

a support (20, 21, 22) comprising:

at least one locking mechanism (204,205);

wherein the support is temporarily fastened in a releasable manner by means of the at least one locking mechanism at the containers corners (9) of at least one of the containers (7) fastened on the deck of the damaged ship;

a crane stand (27) with at least four diagonal supports (26) mounted on the crane stand, the at least four diagonal supports are mounted on at least four crane feet (24), which are arranged on one of the crane rails (20, 21)

a crane (50) arranged on the support (20, 21, 22), the crane (50) comprising:

a front support arm (51);

a load cable guided over the front arm support, the load cable section leading away from the support arm (51) is connected to a container (7) to be unloaded, and the length of which can be changed wherein the at least one locking mechanism of the support is located opposite the crane;

a bolt (271) located on the crane stand and arranged perpendicular to the longitudinal direction of the at least two crane rails; and a fork piece (80) of the crane, fitted onto the bolt.

2. Rescue device according to claim 1, characterised in that the support has at least two crane rails (20, 21), on which a support structure (22) is arranged, with at least two ends which each have the locking mechanism (204, 205) by which the crane rails (20, 21) are releasably fastened to the container corners (9).

3. Rescue device according to claim 1, characterised in that crane rail pieces (201) have a crane rail piece length corresponding to a container width or length and are mounted on opposing sides of a container (7), and crane rail pieces (201) mounted on containers (7) arranged adjacent to one another are connected by means of connecting pieces (300) in each case to one of the crane rails (20, 21).

4. Rescue device according to claim 1, characterised in that at least one connecting pieces (300) comprise a spacing piece (305).

5. Rescue device according to claim 1, characterised in that end pieces in each case comprising a traction device (100) are arranged on both ends of the crane rails.

6. Rescue device according to claim 5, characterised in that a traction device (100) comprises a strand jack (104).

7. Rescue device according to claim 1, characterised in that the at least four diagonal supports are connected rotatably and lockably to the crane stand by the at least four crane feet via flange connections (40) having elongate holes (43).

8. Rescue device according to claim 7, characterised in that the flange connection (40) has two opposing flanges (41, 41*a*), which are each connected in fixed positions to a tube piece (42) and which project externally over tube walls (45) and are in flat contact with one another and which in each case have opposing elongate holes (43) which are arcuate in the peripheral direction, wherein in each case a screw (46) is guided through the pairs of elongate holes.

9. Rescue device according to claim 8, characterised in that a arc length (b) of the elongate holes (43) is dimensioned in such a way that the tube pieces (42) can be firmly screwed to one another at any angle around their longitudinal axis relative to one another.

10. Rescue device according to claim 1, characterised by adaptor pieces (90) which are arranged in each case between one of the at least four crane feet (24) and a holder (272) on the crane stand (27) which is arranged on a portion of the fork piece (80) facing the crane (50), and which are dimensioned in terms of their length in such a way that they compensate for a heel (28) of the crane rails (20, 21).

11. Rescue device according to claim 1, characterized in that the spacing pieces (305) which compensate for a trim of the at least four crane feet (24) are provided between the at least four crane feet (24) and the diagonal supports (26).

12. Process for rescuing containers (7) which are loaded on a damaged ship (110), comprising the steps of using at least one container stack (6) fastened on a deck (1) of a damaged ship;

mounting a rescue device (8) on at least one container stack (6) fastened on a deck (1) of the damaged ship (110) by:

mounting temporarily and firmly a support structure having at least four diagonal supports on the at least one container stack (6) at container corners (9);

mounting a crane (50) on the support (20, 21, 22);

inserting spacing pieces (305) at connection points of the crane feet (24) and diagonal supports (26) to compensate for a trim of the crane rails;

connecting the diagonal supports (26) to a central crane stand (27) which has a bolt (271) which is oriented parallel to the longitudinal direction of the ship L and onto which is fitted a fork piece (80);

rotating the fork piece about the bolt (271) until the fork piece (80) no longer has a heel in a mounting position; and fixing the mounting position by means of adapter pieces (90) which are in each case arranged between the crane foot (24) and a holder on the crane stand (27) and are dimensioned in terms of their length in such a way that they hold the fork piece (80) in the mounting position; and utilizing the rescue device (8) to mount a further rescue device (111) on at least one further container stack (6).

13. Process according to claim 12, comprising the steps of:

mounting two crane rails (20, 21) parallel to one another on the at least one container stack (6);

mounting a support structure (22) on the two crane rails (20, 21); and mounting a crane (50) on the support structure (22).

14. Process according to claim 12, comprising the steps of:

locking the locking pins (103, 204, 205) of a crane rail piece (201) to container corners (9) of the same container (7); and connecting crane rail pieces (201) of adjacent containers (7) to one another by connecting pieces (300) to which two crane rails (20, 21) extending parallel to one another are connected.

15. Process according to claim 12, comprising the step of: placing two crane feet (24) which are movable to and fro along the crane rails (20, 21) onto each of the crane rails (20, 21).

* * * * *